US011689841B2

(12) United States Patent
Zyskind et al.

(10) Patent No.: US 11,689,841 B2
(45) Date of Patent: Jun. 27, 2023

(54) EARBUD ORIENTATION-BASED BEAMFORMING

(71) Applicant: Microsoft Technology Licensing, LLC, Redmond, WA (US)

(72) Inventors: Amir Zyskind, Tel Aviv (IL); Eliza C. Arango-Vargas, Redmond, WA (US); Olli-Pekka Ahokas, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 17/449,418

(22) Filed: Sep. 29, 2021

(65) Prior Publication Data

US 2023/0100759 A1 Mar. 30, 2023

(51) Int. Cl.

| | |
|---|---|
| ***H04R 1/10*** | (2006.01) |
| ***H04R 1/40*** | (2006.01) |
| *H04R 5/02* | (2006.01) |

(52) U.S. Cl.

CPC ..... *H04R 1/1041* (2013.01); *H04R 1/1016* (2013.01); *H04R 1/406* (2013.01)

(58) Field of Classification Search

CPC ..... H04R 1/1041; H04R 1/1016; H04R 1/406
USPC ..... 381/74, 309
See application file for complete search history.

(56) References Cited

U.S. PATENT DOCUMENTS

| | | | |
|---|---|---|---|
| 9,516,442 B1 | 12/2016 | Dusan et al. | |
| 2013/0272097 A1 | 10/2013 | Kim et al. | |
| 2014/0006026 A1 | 1/2014 | Lamb et al. | |
| 2015/0078597 A1 | 3/2015 | Andrea | |
| 2017/0127172 A1* | 5/2017 | Dusan | G10L 21/0208 |
| 2017/0347348 A1 | 11/2017 | Masaki et al. | |
| 2019/0272842 A1 | 9/2019 | Bryan et al. | |
| 2020/0174734 A1 | 6/2020 | Gomes et al. | |
| 2020/0304901 A1 | 9/2020 | Perry et al. | |
| 2022/0070567 A1* | 3/2022 | Skoglund | H04R 25/407 |

FOREIGN PATENT DOCUMENTS

| | | |
|---|---|---|
| EP | 3267697 A1 | 1/2018 |
| WO | 2016131064 A1 | 8/2016 |

OTHER PUBLICATIONS

Yang, et al., "Personalizing Head Related Transfer Functions for Earables", In Proceedings of SIGCOMM, Aug. 23, 2021, 14 Pages.
"International Search Report and Written Opinion Issued in PCT Application No. PCT/US22/038114", dated Nov. 10, 2022, 9 Pages.

* cited by examiner

*Primary Examiner* — Ammar T Hamid
(74) *Attorney, Agent, or Firm* — Alleman Hall Creasman & Tuttle LLP

(57) ABSTRACT

An earbud includes an earbud speaker, a microphone array including a plurality of microphones, an orientation sensing subsystem, and a beamforming subsystem. The orientation sensing subsystem is configured to output an orientation signal indicating an orientation of the earbud. The beamforming subsystem is configured to output a beamformed signal. The beamformed signal is based at least on the orientation signal and a plurality of microphone signals from the plurality of microphones in the microphone array. The beamformed signal spatially selectively filters the plurality of microphone signals.

18 Claims, 8 Drawing Sheets

EARBUD ORIENTATION-BASED BEAMFORMING

BACKGROUND

Beamforming may be used to increase a signal-to-noise ratio of a signal of interest within a set of received signals. A beamformed signal may focus a received signal pattern in the direction of the signal of interest in order to reduce interference from other signals and increase the signal-to-noise ratio of the signal of interest. For example, beamforming may be applied to audio signals captured by a microphone array through spatial filtering of the individual audio signals output by individual microphones of the microphone array.

SUMMARY

An earbud includes an earbud speaker, a microphone array including a plurality of microphones, an orientation sensing subsystem, and a beamforming subsystem. The orientation sensing subsystem is configured to output an orientation signal indicating an orientation of the earbud. The beamforming subsystem is configured to output a beamformed signal. The beamformed signal is based at least on the orientation signal and a plurality of microphone signals from the plurality of microphones in the microphone array. The beamformed signal spatially selectively filters the plurality of microphone signals.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
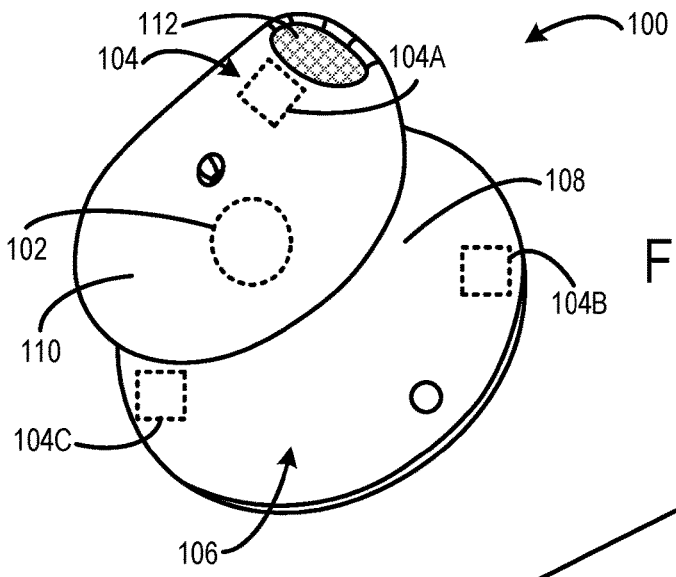
FIGS. 1-3 show an example earbud.
Figure 2:
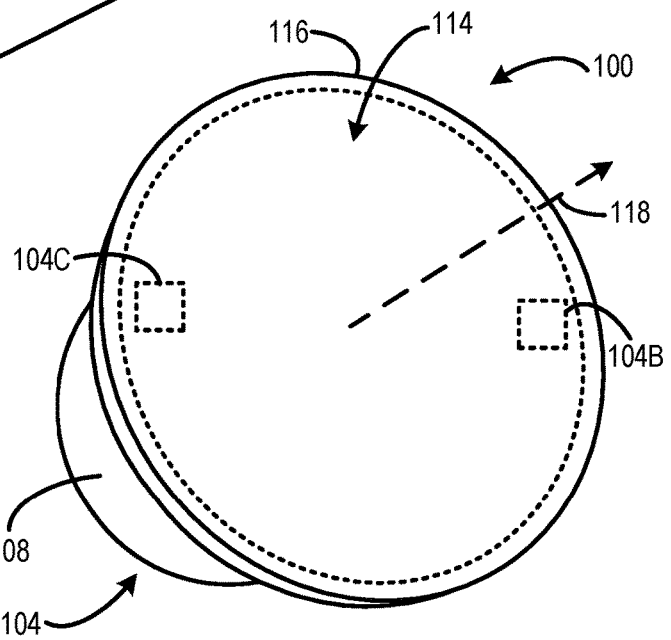
Figure 3:
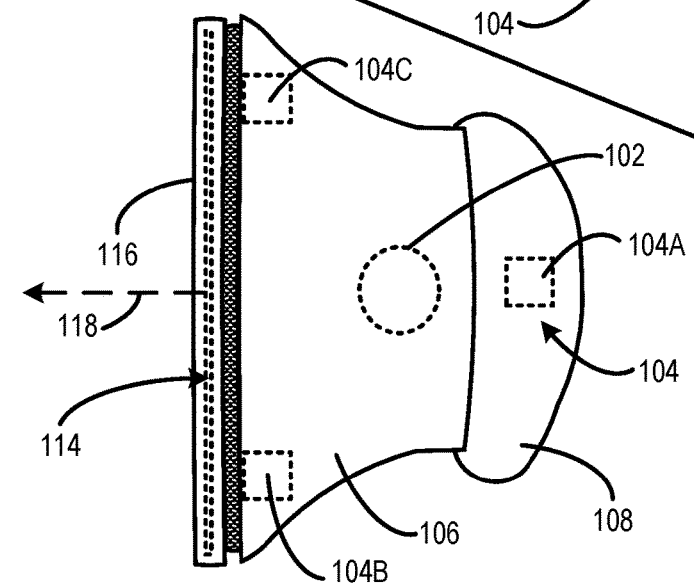

FIGS. 1-3 show an example earbud 100 that is configured as a wireless audio device to be worn in a user's left ear. The earbud 100 includes an earbud speaker 102 configured to emit sound into the user's left ear. The earbud 100 includes a microphone array 104 configured to capture sound emitted from the user's mouth and the surrounding environment. The microphone array 104 includes a plurality of microphones 104A, 104B, 104C.

The earbud 100 is configured to provide beamforming functionality that is dynamically tailored for a user that is wearing the earbud 100. Such beamforming functionality is dynamically set based at least on an orientation of the earbud 100. For example, a beamformed signal may be configured to spatially selectively filter a plurality of microphone signals of the microphone array 104 based at least on an orientation of the earbud 100. Such orientation-based beamforming functionality may enhance an audio signal corresponding to sound emitted from the user's mouth while suppressing background noise in the surrounding environment. In other words, the beamformed signal may be aimed at the user's mouth using the orientation of the earbud 100, such that sound quality of the user's speech captured by the microphone array 104 may be increased relative to an earbud configured to output a nondirectional signal or a beamformed signal having a fixed direction.

Note that the terminology "based on" and "based at least on" as used herein is not necessarily tied to a sole effect resulting from a single listed cause. In some instances, multiple causes listed or unlisted may collectively contribute to an effect. In other instances, multiple causes listed or unlisted may alternatively result in an effect. In still other instances, a single cause may result in an effect.

The earbud 100 includes a housing 106. The housing 106 may be formed from any suitable materials including, but not limited to, plastic, metal, ceramic, glass, crystalline materials, composite materials, or other suitable materials. As shown in FIG. 1, the housing 106 includes a neck 108 and a bud 110. The neck 108 is sized and shaped to position the bud 110 against the concha, a hollow depression in the user's ear, when the earbud 100 is placed in the user's ear. The bud 110 includes a speaker port 112. The bud 110 is sized and shaped to align the speaker port 112 to direct sound emitted from the earbud speaker 102 into the user's ear canal when the earbud 100 is in the user's ear.

In the illustrated implementation, the microphone array 104 includes an in-ear microphone 104A, a first voice microphone 104B, and a second voice microphone 104C. The in-ear microphone 104A is positioned proximate to the speaker port 112 in the bud 110. The first voice microphone 104B and the second voice microphone 104C are positioned at the base of the neck 108.

The in-ear microphone 104A is configured to capture primarily sound in the user's ear. Since the in-ear microphone 104A is inside the ear, the in-ear microphone 104A may be more sensitive to picking up higher-frequency background noise that bleeds through between the earbud 100 and the user's ear. Lower-frequency background noise may be at least partially blocked by the physical seal of the earbud 100 against the user's ear.

The first voice microphone 104B is positioned closer to the user's mouth when the earbud 100 is in the user's ear. The first voice microphone 104B is configured to capture primarily sound emitted from the user's mouth. The second voice microphone 104C is positioned further from the user's mouth when the earbud 100 is in the user's ear. The second voice microphone 104C is configured to capture primarily background noise outside of the earbud 100 with relatively high sensitivity to pick up lower frequency noise that may be canceled out through beamforming. The various microphones of the microphone array 104 may collectively capture sounds that can be diagnosed as desirable (e.g., the user's voice) or undesirable (e.g., background noise), and beamforming techniques may be employed to cancel out the undesirable sounds. The first and second voice microphones 104B and 104C may be aimed towards the user's mouth to effectively isolate sound emitted from the user's mouth. If such alignment does not occur by default due to variance in shape of the user's ear, then an estimated orientation of the earbud 100 relative to the user's ear may be used to effectively aim the first and second voice microphones 104B and 104C with the user's mouth via beamforming for suitable spatial filtering.

The microphone array 104 may include any suitable number of microphones including two, three, four, or more microphones. Moreover, the plurality of microphones of the microphone array 104 may be positioned at any suitable position and/or orientation within the earbud 100. In some examples, different microphones of the array may have a primary function/capture a primary type of sound (e.g., higher frequency, lower frequency, voice), however each of the microphones may also capture other types of sound.

As shown in FIGS. 2 and 3, the earbud 100 includes a touch sensor 114 configured to receive touch input from the user's fingers. Touch input to the touch sensor 114 may be used to provide playback control and various other functionality of the earbud 100. Further, touch input to the touch sensor 114 may be used to determine an orientation of the earbud 100 as will be discussed in further detail below. In the illustrated implementation, the touch sensor 114 includes a circular touch input surface 116 that is symmetric about an axis 118 extending perpendicularly from the touch input surface 116 through the center of the circle. As a result, the circular touch input surface 116 visually appears the same and tactically feels the same to a user's finger regardless of an orientation (i.e., rotation angle) of the earbud 100 within the user's ear. In other implementations, the touch sensor 114 may have a non-symmetric shaped touch input surface, and touch input to such a non-symmetric touch input surface may be used to determine an orientation of the earbud 100.

A corresponding right-side earbud (not shown) may be worn in the user's right ear to allow for the user to listen to audio in the user's right ear. The right-side earbud may be configured to provide the same functionality as the earbud 100 including providing beamforming functionality that is dynamically tailored for the user based at least on an orientation of the right-side earbud in the user's ear. The right-side earbud and the left-side earbud 100 may be worn together to provide stereo (and/or spatially enhanced) audio playback. In some implementations, audio information may be shared between the left and right earbuds, such that beamforming functionality may be provided collectively. For example, a microphone array that provides beamforming functionality may include microphones from both the left and right earbuds.

Figure 4:
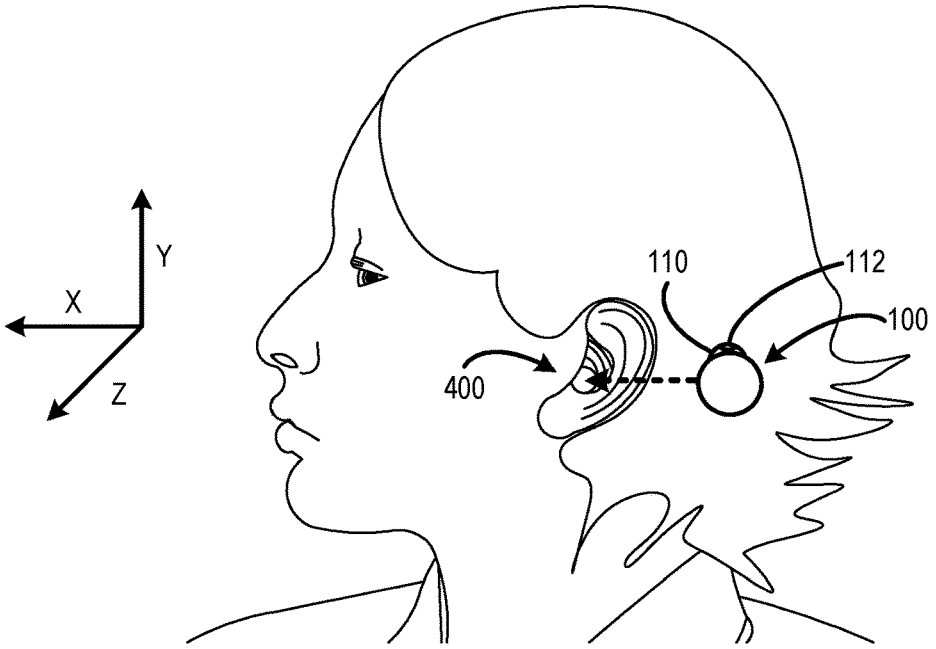
FIGS. 4-6 show an example technique for inserting an earbud into a user's ear.
Figure 5:
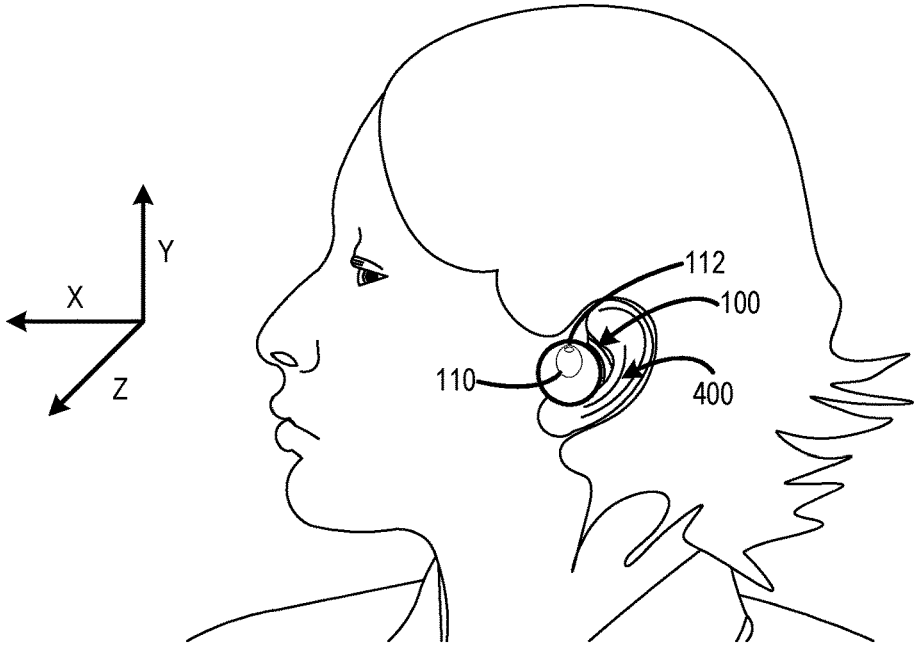
Figure 6:
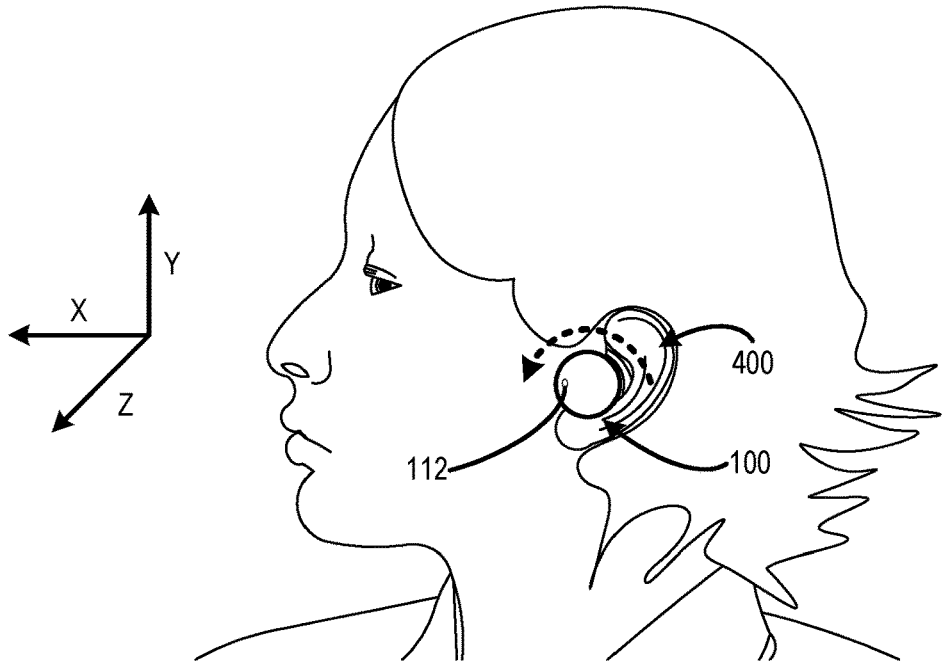

FIGS. 4-6 show an example technique for inserting the earbud 100 into a user's ear. In FIG. 4, the earbud 100 is oriented such that the speaker port 112 is pointing upwards (in the Y direction). Such an orientation allows for the bud 110 to be inserted into the user's ear 400. In FIG. 5, the earbud 100 is shown with the bud 110 residing in the user's ear 400 with the speaker port 112 still pointing upwards (in the Y direction). In FIG. 6, the earbud 100 is rotated counterclockwise such that the speaker port 112 is pointing leftward (in the X direction). The earbud 100 may be rotated in this manner to align the speaker port 112 with the user's ear canal to direct sound emitted from the earbud 100 into the user's ear canal. Additionally, rotating the earbud 100 in this manner causes the earbud 100 to wedge into the user's ear 400 to inhibit the earbud 100 from falling out of the user's ear 400 and to create a seal that allows for increased sound isolation in the user's ear.

The earbud 100 is provided as a non-limiting example. The earbud 100 may take any suitable shape. For example, in some implementations, the touch sensor may assume a different symmetrical shape, such as a regular octagon, or a different nonsymmetrical shape, such as a non-square rectangle. In some implementations, the touch sensor may be omitted from the earbud 100.

The concepts described herein are broadly applicable to differently sized and shaped earbuds (also referred to as headphones). In the illustrated implementation, the earbud 100 is sized and shaped to fit in a user' ear. In other implementations, an earbud may be sized and shaped to fit on an exterior portion of the user's ear or cover at least a portion of a user's ear.

The size, shape, and general ergonomics of different user's ears may vary causing the degree to which the earbud 100 is rotated within the user's ear to vary from user to user. Correspondingly, such variation causes an orientation of the earbud 100 within different user's ears to vary from user to user.

Figure 7:
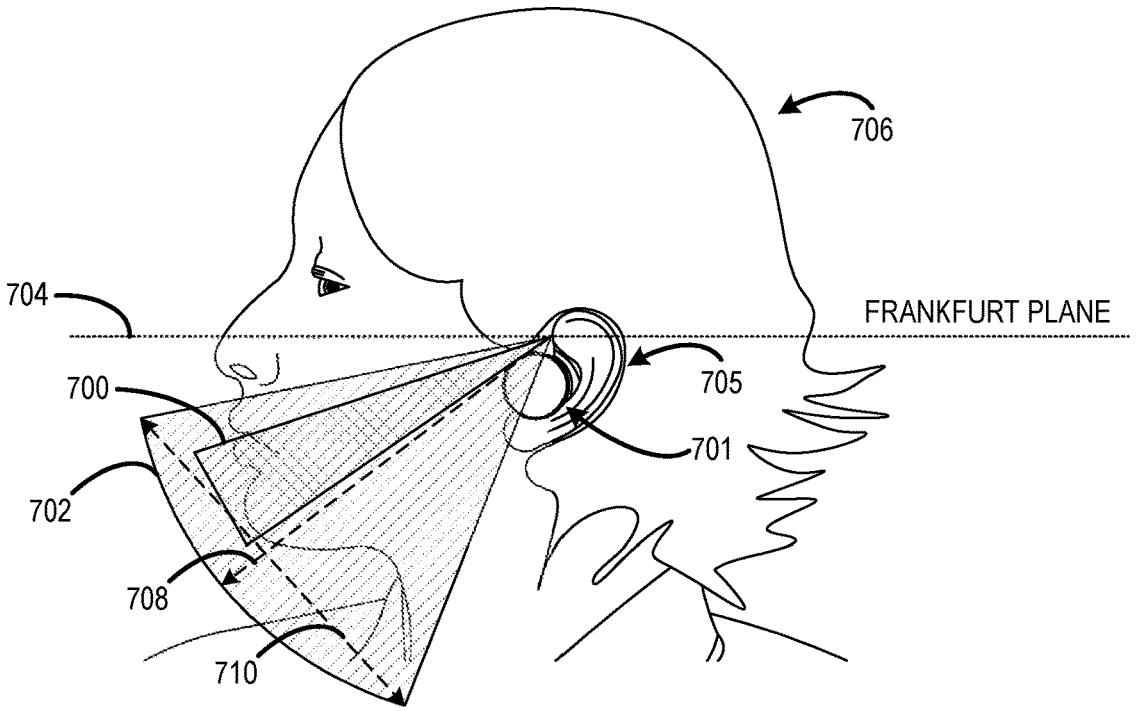
FIG. 7 shows an example mouth position variance cone and an example microphone alignment variance cone of an earbud across a population of different users.

FIG. 7 shows an example mouth position variance cone 700 across a population of different human subjects and an example microphone alignment variance cone 702 of an earbud 701. The mouth position variance cone 700 and the microphone alignment variance cone 702 are positioned relative to the Frankfurt plane 704 that approximates the position of the user's ear 705 and also approximates a position in which the user's skull 706 would be if the subject is standing upright and facing forward.

The mouth position variance cone 700 defines a range of mouth position relative to the Frankfurt plane 704 across a population of human subjects. The mouth position is defined in terms of an ear-to mouth angle. In one example, a 95% expected deviation corresponds to an ear-to-mouth angle of −28.3 degrees relative to the Frankfurt plane 704, a 50% expected deviation corresponds to an ear-to-mouth angle of −34. 5 degrees relative to the Frankfurt plane 704, and a 5% expected deviation corresponds to an ear-to-mouth angle of −41 degrees relative to the Frankfurt plane 704.

The microphone alignment variance cone 702 defines a range of operation that includes a direction 708 and an angular width 710 of a beamformed signal output from the earbud 701. In one example, a 95% expected deviation corresponds to a beamformed signal angle of −21.3 degrees relative to the Frankfurt plane 704, a 50% expected deviation corresponds to a beamformed signal angle of −45.9 degrees relative to the Frankfurt plane 704, and a 5% expected deviation corresponds to a beamformed signal angle of −79.8 degrees relative to the Frankfurt plane 704.

Due to the expected high variance between mouth position and microphone alignment across the potential population of human subjects, an earbud that outputs a beamformed signal having a fixed direction and a fixed angular width may not align with a particular user's mouth. Such misalignment may cause a reduction of a signal-to-noise ratio of a signal corresponding to sound emitted from the user's mouth and captured by the microphone array of the earbud. In other words, the sound quality of the user may be reduced relative to an arrangement where the beamformed signal is aligned with the user's mouth and sufficiently narrow to block a high percentage of sounds not originating at the user's mouth.

Figure 8:
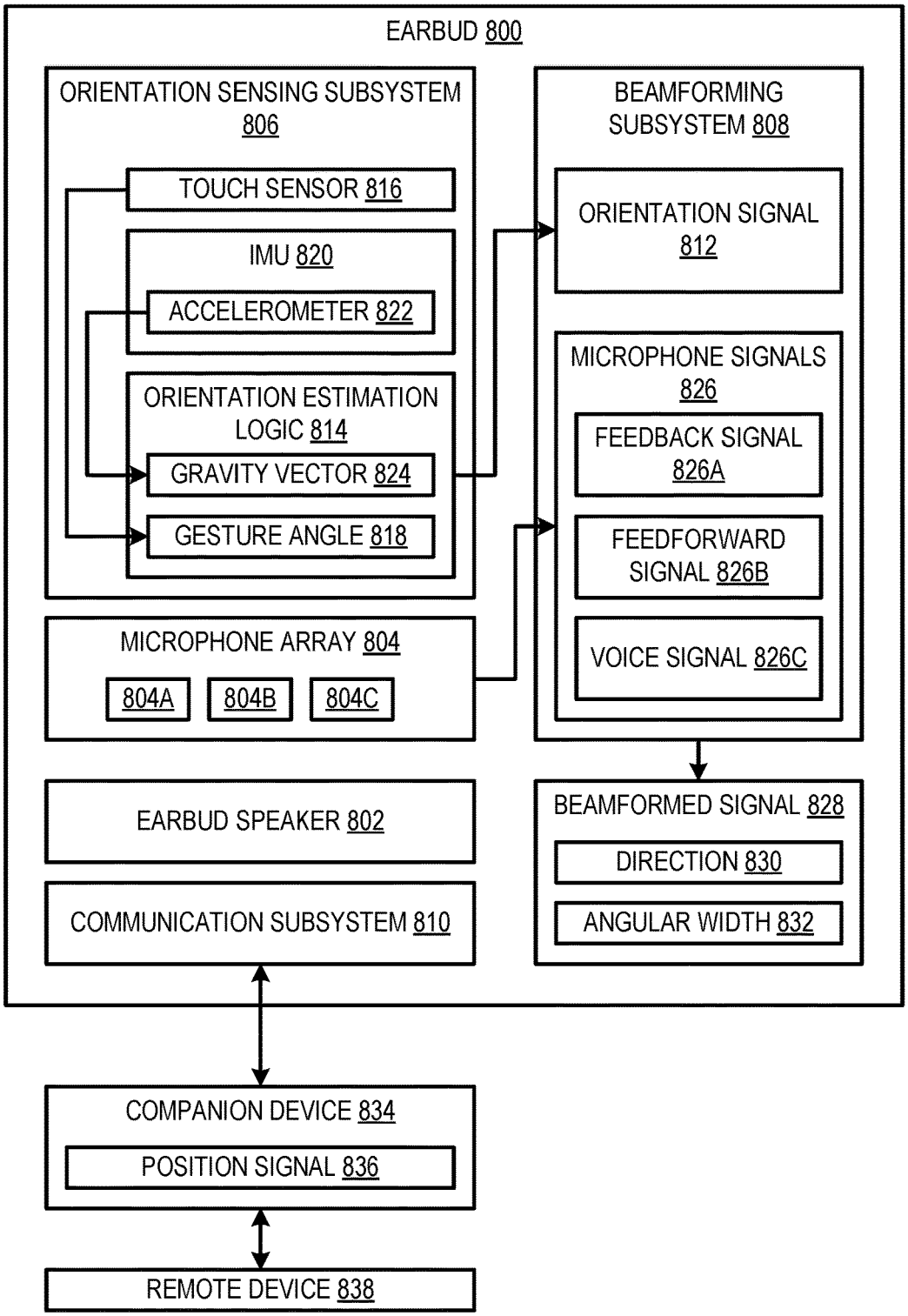
FIG. 8 shows an example block diagram of an earbud.

FIG. 8 shows an example block diagram of an earbud 800 configured to provide beamforming functionality that is dynamically tailored for a user that is wearing the earbud 800. Such beamforming functionality is dynamically set based at least on an orientation of the earbud 800. In one example, the earbud 800 corresponds to the earbud 100 shown in FIGS. 1-6. In other examples, the earbud 800 may correspond to other forms of earbuds or other types of headphones, such as over-the-ear style headphones.

The earbud 800 includes at least one earbud speaker 802, a microphone array 804, an orientation sensing subsystem 806, a beamforming subsystem 808, and a communication subsystem 810. The earbud speaker 802 is configured to emit sound into a user's ear. In one example, the earbud speaker 802 corresponds to the earbud speaker 102 of the earbud 100 shown in FIGS. 1-6. The microphone array 804 is configured to capture sound emitted from the user's mouth and the surrounding environment as well as audio playback of the earbud speaker 802. The microphone array 104 includes a plurality of microphones 804A, 804B, 804C. In one example, the plurality of microphones 804A, 804B, 804C correspond to the plurality of microphones 104A, 104B, 104C of the earbud 100 shown in FIGS. 1-6. The microphone array 804 may include any suitable number of microphones.

The orientation sensing subsystem 806 is configured to output an orientation signal 812 indicating an orientation of the earbud 800. The orientation signal 812 may be used to estimate a spatial relationship between a user's mouth and the earbud 800. By knowing the orientation of the earbud 800 in relation to the position of the user's mouth, the earbud 800 may output a beamformed signal 828 that is aimed at the user's mouth based at least on the orientation signal 800 to more accurately isolate speech emitted from the user's mouth from other background noise.

In one example, the orientation of the earbud 800 may be defined in terms of a rotational offset relative to a default position of the earbud 800. The orientation sensing subsystem 806 includes orientation estimation logic 814 that is configured to estimate the orientation of the earbud 800. In some instances, the orientation estimation logic 814 may be configured to estimate the orientation of the earbud 800 using an instantaneous sample or snapshot of orientation information determined from a signal of a sensor of the earbud 800. In other instances, the orientation estimation logic 814 may be configured to refine the estimation of the orientation of the earbud 800 over time based at least on a plurality of samples of orientation information determined from a plurality of tracked signals from a sensor of the earbud 800. In still other instances, the orientation estimation logic 814 may be configured to estimate the orientation of the earbud 800 based at least on a plurality of different tracked signals from a plurality of sensors of the earbud 800 using sensor fusion. The orientation estimation logic 814 may be configured to estimate the orientation of the earbud 800 using any suitable technique(s).

In some implementations, the orientation sensing subsystem 806 includes a touch sensor 816. For example, the touch sensor 816 may correspond to the touch sensor 116 of the earbud 100 shown in FIGS. 1-3. In such implementations, the orientation estimation logic 814 may be configured to assess a gesture angle 818 of a directional gesture based at least on touch input on the touch sensor 816 and output the orientation signal 812 based at least on the gesture angle 818. A directional gesture may include any suitable touch input from which an angle or direction (e.g., horizontal, vertical) can be determined for estimating the orientation of the earbud 800. In other words, a directional gesture may include any gesture that does not have axial symmetry ambiguity.

When included in the earbud 800, the touch sensor 816 may be leveraged to provide the dual benefits of being a mechanism for receiving touch input gestures to control operation of the earbud 800 as well as being a mechanism for receiving directional gestures from which an estimation of orientation of the earbud 800 may be determined. In other words, the earbud 800 may be configured to use the already present touch sensor 816 to estimate the orientation of the earbud 800 in addition to providing normal touch input control functionality.

Figure 9:
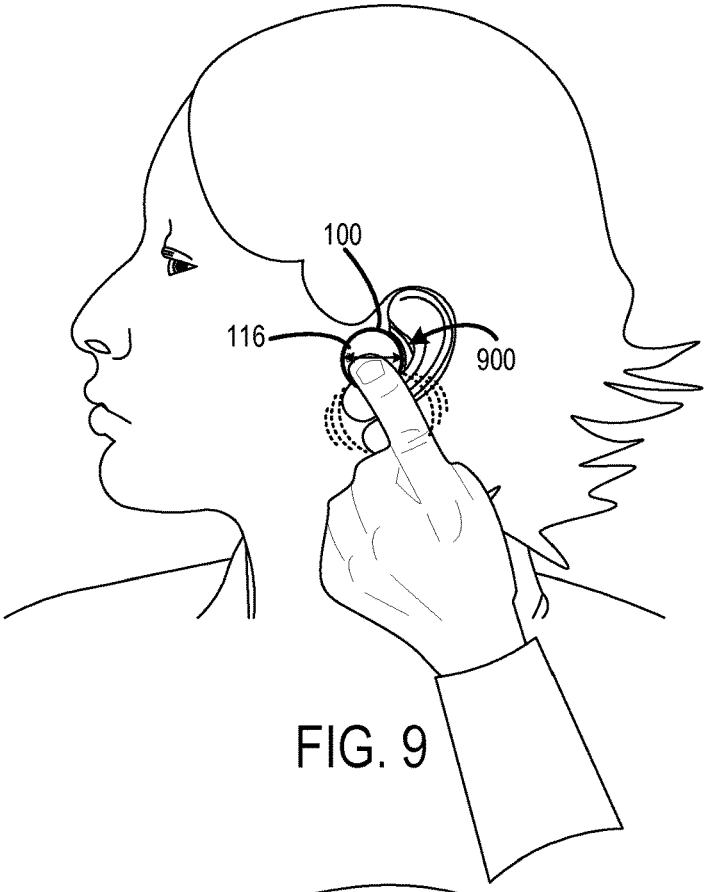
FIGS. 9-10 show example scenarios of a user providing touch input to a touch sensor of an earbud.
Figure 10:
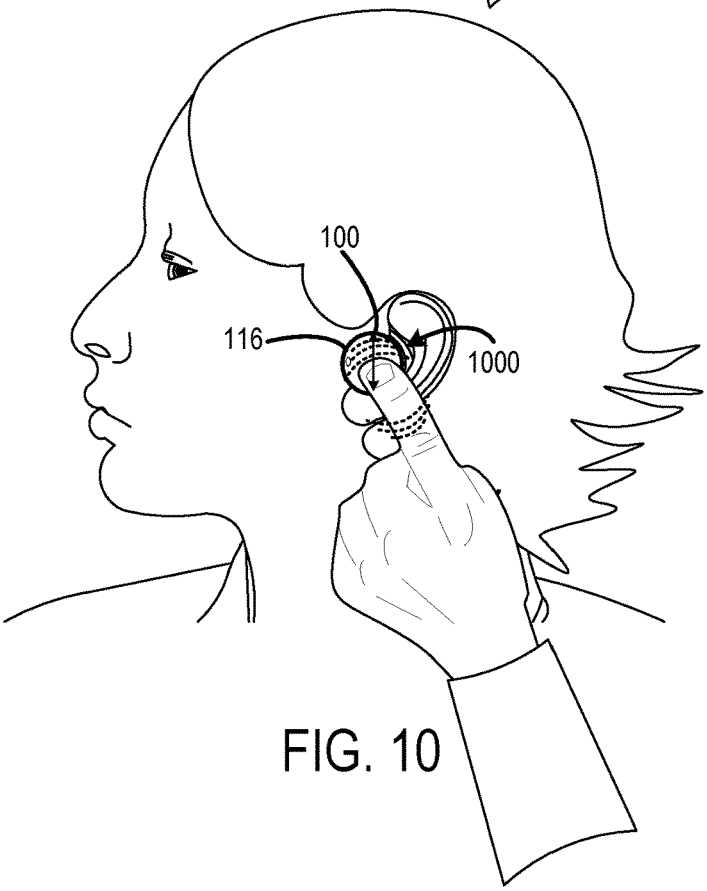

FIGS. 9-10 show example scenarios of a user providing touch input to a touch sensor of an earbud that may be assessed to identify a directional gesture that may be used to estimate an orientation of an earbud. In FIG. 9, the user performs a horizontal swipe gesture 900 on the touch sensor 116 of the earbud 100. The horizontal swipe gesture 900 may be a forward to backward swipe across the touch sensor 116 or vice versa. In some instances, the user may perform the horizontal swipe gesture 900 as part of normal operation of the earbud 100. For example, the user may perform the horizontal swipe gesture 900 to switch to a next song in a playlist or to perform some other control function. In other instances, the user may perform the horizontal swipe gesture 900 in response to a request presented by the orientation sensing subsystem 806 in order to estimate the orientation of the earbud 100. For example, such as request may be presented based at least on the orientation sensing subsystem 806 detecting that the earbud 800 is placed in the user's ear.

In FIG. 10, the user performs a vertical swipe gesture 1000 on the touch sensor 116 of the earbud 100. The vertical swipe gesture 1000 may be an up to down swipe across the touch sensor 116 or vice versa. In some instances, the user may perform the vertical swipe gesture 1000 as part of normal operation of the earbud 100. For example, the user may perform the vertical swipe gesture 1000 to increase or decrease volume of audio playback or to perform some other control function. In other instances, the user may perform the vertical swipe gesture 1000 in response to a request presented by the orientation sensing subsystem 806 in order to estimate the orientation of the earbud 100. For example, such as request may be presented based at least on the orientation sensing subsystem 806 detecting that the earbud 800 is placed in the user's ear.

Returning to FIG. 8, the orientation estimation logic 814 is configured to correlate the relative angle between the earbud axes (X, Y) and a gesture angle 818 of a directional gesture (e.g., the horizontal swipe gesture 900 shown in FIG. 9 or the vertical swipe gesture 1000 shown in FIG. 10) to estimate the orientation of the earbud 800 that is indicated by the orientation signal 812. In other examples, the gesture angle 818 may be determined from gestures of letters like X, T, N, etc.

The correlation of the gesture angle of the directional gesture to the orientation of the earbud is especially useful in implementations where the touch sensor has a symmetrical touch surface, since the orientation of the earbud is not easily perceived by the user when the earbud is placed in the user's ear. However, the concept of estimating earbud orientation from a gesture angle is also applicable to an earbud having a non-symmetrical shape.

In some instances, the orientation estimation logic 814 may be configured to assess a single gesture angle 818 corresponding to a single directional gesture and output the orientation signal 812 based at least on the single assessed gesture angle. In other instances, the orientation estimation logic 814 may be configured to assess a plurality of gesture angles 818 corresponding to a plurality of directional gestures and output the orientation signal 812 based at least on the plurality of gesture angles 818. Multiple gesture angle assessments may make the estimation of the orientation more robust/accurate relative to an estimation of orientation that is based at least on a single gesture angle assessment.

In some implementations, the orientation sensing subsystem 806 may include an inertial measurement unit (IMU) 820. The IMU 820 is configured to determine acceleration and/or orientation of the earbud 100. The IMU 820 includes at least one accelerometer 822 configured to measure acceleration. The orientation estimation logic 814 may be configured to determine a gravity vector 824 that points toward the Earth's center of mass based at least on acceleration measured by the at least one accelerometer 822 and deduce the orientation in which the earbud 800 is placed in the user's ear from the gravity vector 824, such that the orientation signal 812 is based at least on the gravity vector 824.

In some examples, the orientation estimation logic 814 may be configured to determine the orientation of the earbud 800 in a relatively static scenario (e.g., where there are no external accelerations). In some examples, the orientation estimation logic 814 may be configured to determine the orientation of the earbud 800 during moving scenarios where the orientation estimation logic 814 may account for motion-based potential errors. Such orientation determination may be made in conjunction with determining when the user is in an upright position where the gravity vector 824 is parallel or at least nearly parallel with the user's body.

In some instances, the orientation estimation logic 814 may be configured to estimate the orientation of the earbud 800 based at least on a single determination of the gravity vector 824 based at least on measurements of the accelerometer 822. In other instances, the orientation estimation logic 814 may be configured to track the gravity vector 824 over time and estimate the orientation of the earbud 800 based at least on a plurality of samples of the gravity vector 824.

In some implementations, the orientation estimation logic 814 may be configured to distinguish between an upright position where the gravity vector 824 is parallel or at least nearly parallel with the user's body and a non-upright position of the user where the gravity vector 824 is not parallel with the user's body. For example, the user's position may be determined based at least on motion determined by the IMU 820. The orientation estimation logic 814 may be configured to adapt the user's position over time based at least on sampling of the gravity vector 824 and/or other motion determinations sampled by the IMU 820 over time. Such recognition and tracking of the user's position may allow for the orientation estimation logic 814 to make intelligent decisions about when to use the gravity vector 824 to estimate the orientation of the earbud 800. For example, the orientation estimation logic 814 may be configured to use the gravity vector 824 to estimate the orientation of the earbud 800 when the user is in the upright position, such as when the user is walking or running. On the other hand, the orientation estimation logic 814 may be configured to filter out the gravity vector 824 (and/or another tracked signal of a sensor) from being used to estimate the orientation of the earbud 800 when the user is in the non-upright position, such as when the user is lying down or reclining. The gravity vector 824 may be filtered out from being used when the user is in the non-upright position because the gravity vector 824 does not accurately correlate to the orientation of the earbud 800 when the user is not upright.

In some implementations, the orientation estimation logic 814 may be configured to output the orientation signal 812 based at least on fused consideration of a plurality of tracked signals of sensors (e.g., the gesture angle 818 and the gravity vector 824). For example, the orientation estimation logic 814 may employ sensor fusion techniques to cooperatively analyze the gesture angle 818 and the gravity vector 824 to estimate the orientation of the earbud 800, such that the resulting estimation of orientation has less uncertainty than would be possible when these sources of orientation information are used individually. Any suitable sensor fusion techniques may be employed by the orientation estimation logic 814 to estimate the orientation of the earbud 800. In one example, the orientation estimation logic 814 may use the gesture angle 818 for the estimation of orientation instead of the gravity vector 824 when the orientation estimation logic 814 determines that the user is in the non-upright position. Under these conditions, the gesture angle 818 may provide a more accurate estimation of the orientation of the earbud 800 than the gravity vector 824. In some examples, the orientation estimation logic 814 may employ a weighting algorithm to determine the reliability of each of the gravity vector 824 and the gesture angle 818 for use in the estimation of orientation.

The beamforming subsystem 808 is configured to receive the orientation signal 812 from the orientation sensing subsystem 806. The beamforming subsystem 808 is configured to receive a plurality of microphone signals 826 from the plurality of microphones 804A, 804B, 804C of the microphone array 804. The beamforming subsystem 808 is configured to output the beamformed signal 828 based at least on the orientation signal 812 and two or more microphone signals 826 from the plurality of microphones 804A, 804B, 804C in the microphone array 804. The beamformed signal 828 may spatially selectively filter the plurality of microphone signals 826. In one example, the beamforming subsystem 808 is configured to use an end-fire beam forming algorithm to improve the audio quality of the user's voice while filtering out background noise based at least on the orientation signal 812. The beamforming subsystem 808 may utilize any suitable beamforming signal processing techniques to capture a user's voice, background noise, audio playback, and other sounds via various microphones of the microphone array 804 and subtract the captured sounds other than the user's voice to isolate the user's voice in the beamformed signal 828.

In some instances, the beamforming subsystem 808 may be configured to set a direction 830 of the beamformed signal 828 relative to the earbud 800 based at least on the orientation signal 812. For example, the direction 830 of the beamformed signal 828 may be set to align with the expected position of the user's mouth based at least on the orientation of the earbud 800. By aligning the direction 830 of the beamformed signal 828 with the user's mouth, the beamformed signal 828 may more accurately isolate speech emitted from the user's mouth while filtering out other background noise relative to an earbud that outputs a beamformed signal having a fixed direction. In some instances, the direction 830 of the beamformed signal 828 may be set by dynamically rotating the beamformed signal 828 relative to a default position based at least on the orientation signal 812.

In some instances, the beamforming subsystem 808 is configured to set an angular width 832 of the beamformed signal based at least on the orientation signal 812. For example, the angular width 832 of the beamformed signal 828 may be set to cover an expected angular width of the user's mouth based at least on the orientation of the earbud 800. By setting the angular width 832 of the beamformed signal 828 to cover the expected angular width of the user' mouth, the beamformed signal 828 may more accurately isolate speech emitted from the user's mouth while filtering out other background noise relative to an earbud that outputs a beamformed signal having a fixed angular width. In some instances, the angular width 832 of the beamformed signal 828 may be set by dynamically widening or narrowing the beamformed signal 828 relative to a default angular width based at least on the orientation signal 812.

The communication subsystem 810 may be configured to communicatively couple the earbud 800 with a companion device 834. In some instances, the communication subsystem 810 may be configured to communicatively couple the earbud 800 with the companion device 834 via a wireless connection, such as BluetoothTM or Wifi. In other instances, the communication subsystem 810 may be configured to communicatively couple the earbud 800 with the companion device 834 via a wired connection. The companion device 834 may include any suitable type of device including, but not limited to, a smartphone, a tablet computer, a laptop computer, a desktop computer, an augmented reality device, a wearable computing device, a gaming console, an audio source device, a communication device, or another type of computing device.

In some instances, the companion device 834 may send audio signals to the earbud 800 for playback via the earbud speaker 802. For example, such audio signals may include music, podcasts, audio synched with video that is visually presented via the companion device, phone conversations, or the like.

In some instances, the companion device 834 may receive the beamformed signal 828 from the earbud 800. The companion device 834 may perform any suitable operation using the beamformed signal 828. As one example, the companion device 834 may emit the beamformed signal 828 via an audio speaker of the companion device 834. As another example, the companion device 834 may perform further audio processing operations of the beamformed signal 828. Further, in some instances, the companion device 834 may send the beamformed signal to a remote device 838. For example, the remote device 838 may include a companion device of another remote user, such as a remote user that is having a conversation with the user that is wearing the earbud 800. The beamforming subsystem 808 may be configured to output the beamformed signal 828 to any suitable destination.

In some implementations, the companion device 834 may be configured to output a position signal 836 indicating a user's position (e.g., an upright position or a non-upright position). For example, the companion device 834 may take the form of a smartphone or a wearable device including sensors and corresponding logic configured to determine the user's position. The orientation sensing subsystem 806 may be configured to receive, from the companion device 834 via the communication subsystem 810, the position signal 836. The orientation estimation logic 814 may be configured to use the position signal 836 (instead of or in addition to other orientation sensing information (e.g., a gesture angle on the touch senor or the gravity vector of the accelerometer)) to output the orientation signal 812 indicating the orientation of the earbud 800. For example, the orientation sensing logic 814 may use the position signal 836 to filter out at least one tracked sensor signal from being used to estimate the orientation of the earbud 800 when the position signal 836 indicates that the user is in the non-upright position. In some instances, the position signal 836 may be used instead of, or in addition to a determination of the user's position by the orientation estimation logic 814. In some examples, the companion device 834 may be configured to determine the orientation of the earbud 800 and/or generate the orientation signal 812. In such implementations, the orientation sensing subsystem 806 may be configured to receive, from the companion device 834 via the communication subsystem 810, the orientation signal 812. The beamforming subsystem 808 may set the beamforming signal based at least on the orientation signal 812.

Figure 11:
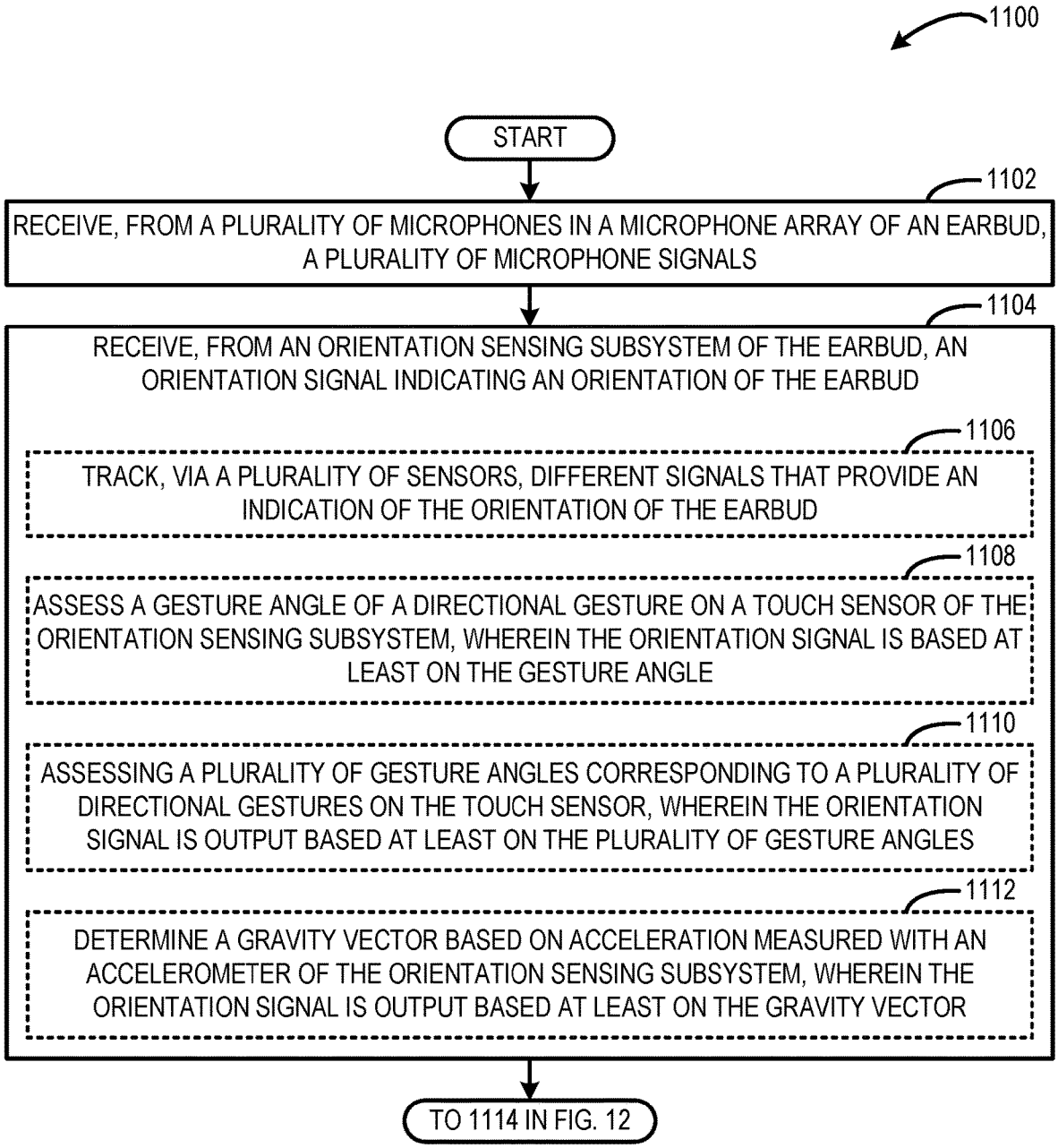
FIGS. 11-12 shows an example method of controlling an earbud.
Figure 12:
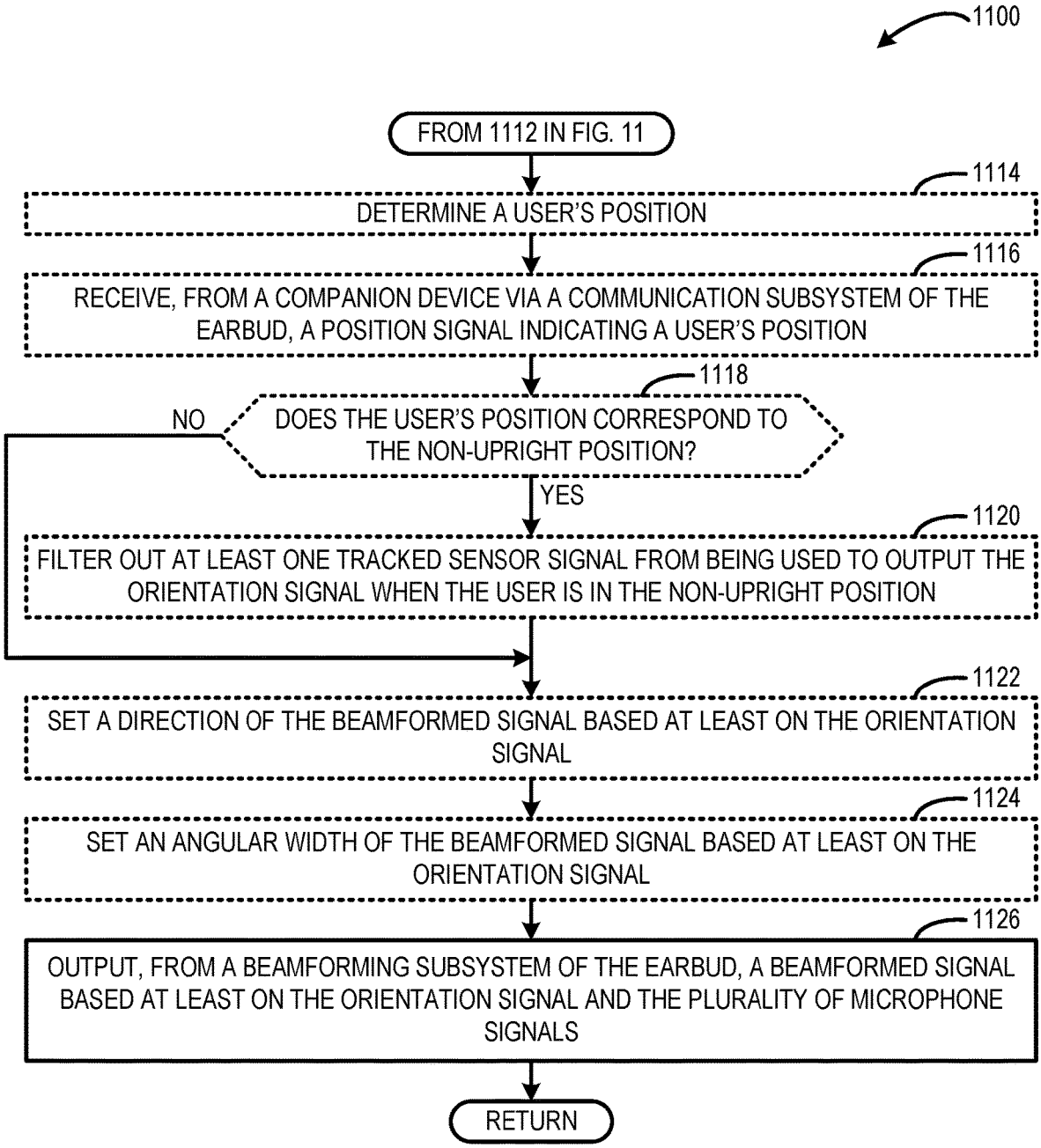

FIGS. 11-12 show an example method 1100 of controlling an earbud to provide beamforming functionality that is dynamically tailored for a user that is wearing the earbud. For example, the method 1100 may be performed by the earbud 100 shown in FIGS. 1-6, the earbud 800 shown in FIG. 8, or any other suitable earbud or headphone.

In FIG. 11, at 1102, the method 1100 includes receiving, from a plurality of microphones in a microphone array of the earbud, a plurality of microphone signals. For example, the plurality of microphone signals may be received from the microphone array 804 shown in FIG. 8.

At 1104, the method 1100 includes receiving, from an orientation sensing subsystem of the earbud, an orientation signal indicating an orientation of the earbud. For example, the orientation signal may be output from the orientation sensing subsystem 806 shown in FIG. 8.

In some implementations where the orientation sensing subsystem includes a plurality of sensors, at 1106, the method 1100 optionally may include tracking, via the plurality of sensors, different signals that provide an indication of the orientation of the earbud. In one example, the plurality of sensors may include the touch sensor 816 and the accelerometer 822 shown in FIG. 8.

In some implementations where the orientation sensing subsystem includes a touch sensor configured to detect touch input, at 1108, the method 1100 optionally may include assessing a gesture angle of a directional gesture on the touch sensor. In such implementations, the orientation signal may be output based at least on the gesture angle.

In some implementations where the orientation sensing subsystem includes a touch sensor configured to detect touch input, at 1110, the method 1100 optionally may include assessing a plurality of gesture angles corresponding to a plurality of directional gestures on the touch sensor. In such implementations, the orientation signal may be output based at least on the plurality of gesture angles. For example, the plurality of gesture angles may be tracked over time and the orientation of the earbud may be estimated with greater confidence as more gesture angles are assessed.

In some implementations where the orientation sensing subsystem includes an accelerometer configured to measure acceleration, at 1112, the method 1100 optionally may include determining a gravity vector based at least on the measured acceleration. In such implementations, the orientation signal may be output based at least on the gravity vector.

In some implementations where the orientation sensing subsystem includes an accelerometer and a touch sensor, the orientation signal may be output based at least on the gravity vector and the gesture angle(s).

Turning to FIG. 12, in some implementations, at 1114, the method 1100 optionally may include determining a position of the user that is wearing the earbud (e.g., based at least on a gravity vector). The user's position may be learned and tracked over time based at least on repeated sampling of the gravity vector over time and/or based at least on another form of position determination. For example, the user's position may include an upright position (e.g., walking or running) where the gravity vector is parallel or at least nearly parallel with the user's body or a non-upright position (e.g., lying down or reclining) where the gravity vector is not substantially parallel with the user's body.

In some implementations, at 1116, the method 1100 optionally may include receiving, from a companion device via a communication subsystem of the earbud, a position signal indicating the position of the user. For example, the companion device may include a smartphone or wearable device that includes sensors and corresponding logic configured to determine the position of the user. In one example, the position signal may be received from the companion device 834 shown in FIG. 8.

In some implementations, at 1118, the method 1100 optionally may include determining if the user's position corresponds to the non-upright position. If the user's position corresponds to the non-upright position, then the method 1100 moves to 1120. Otherwise, the method 1100 moves to 1122.

In some implementations, at 1120, the method 1100 optionally may include filtering out at least one tracked sensor signal from being used to output the orientation signal when the user is in the non-upright position. The orientation of the earbud corresponding to the orientation signal may be estimated without using one or more sensor signals (e.g., the gravity vector) when the user is in the non-upright position because such signal(s) may not be indicative of the orientation of the earbud.

In some implementations, at 1122, the method 1100 optionally may include setting a direction of the beamformed signal based at least on the orientation signal.

In some implementations, at 1124, the method 1100 optionally may include setting an angular width of the beamformed signal based at least on the orientation signal.

At 1126, the method 1100 includes outputting, from a beamforming subsystem of the earbud, a beamformed signal based at least on the orientation signal and the plurality of microphone signals. The beamformed signal may spatially selectively filter the plurality of microphone signals. For example, the beamforming signal may be output from the beamforming subsystem 808 shown in FIG. 8.

The method 1100 may be performed to provide beamforming functionality that is dynamically tailored for a user that is wearing the earbud. Such orientation-based beamforming functionality may enhance an audio signal corresponding to sound emitted from the user's mouth while suppressing background noise in the surrounding environment. In other words, the beamformed signal may be aimed at the user's mouth using the orientation of the earbud, such that sound quality of the user's speech captured by the microphone array may be increased relative to an earbud that is configured to output a beamformed signal having a fixed direction and angular width.

In some implementations, the methods and processes described herein may be tied to a computing system of one or more computing devices. In particular, such methods and processes may be implemented as a computer-application program or service, an application-programming interface (API), a library, and/or other computer-program product.

Figure 13:
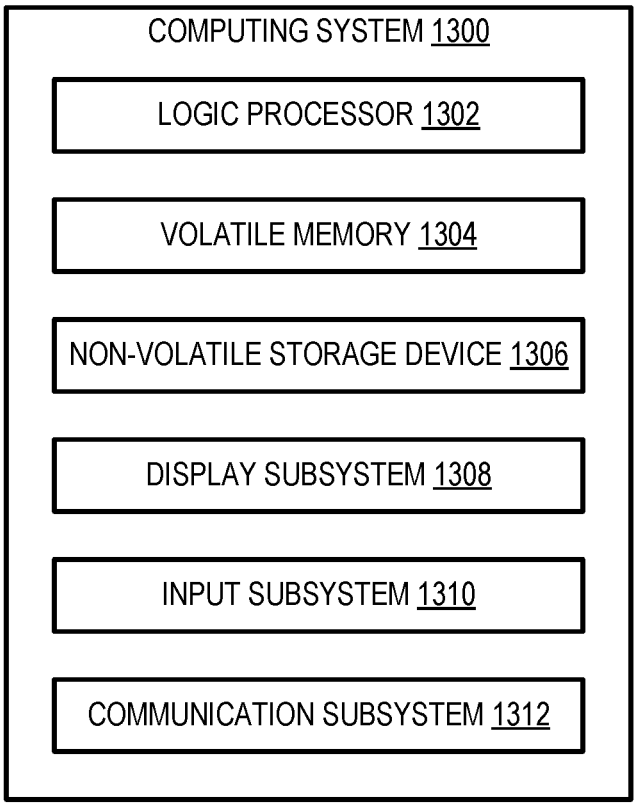
FIG. 13 shows an example computing system.

FIG. 13 schematically shows a non-limiting implementation of a computing system 1300 that can enact one or more of the methods and processes described above. Computing system 1300 is shown in simplified form. Computing system 1300 may embody the earbud 100 shown in FIGS. 1-6, the earbud 701 shown in FIG. 7, the earbud 800 shown in FIG. 8, the companion device 834 shown in FIG. 8, and the remote device 838 shown in FIG. 8. Computing system 1300 may take the form of one or more earbuds, headphones, personal computers, server computers, tablet computers, home-entertainment computers, network computing devices, gaming devices, mobile computing devices, mobile communication devices (e.g., smart phone), and/or other computing devices, and wearable computing devices such as smart wristwatches, backpack host computers, and head-mounted augmented/mixed virtual reality devices.

Computing system 1300 includes a logic processor 1302, volatile memory 1304, and a non-volatile storage device 1306. Computing system 1300 may optionally include a display subsystem 1308, input subsystem 1310, communication subsystem 1312, and/or other components not shown in FIG. 13.

Logic processor 1302 includes one or more physical devices configured to execute instructions. For example, the logic processor may be configured to execute instructions that are part of one or more applications, programs, routines, libraries, objects, components, data structures, or other logical constructs. Such instructions may be implemented to perform a task, implement a data type, transform the state of one or more components, achieve a technical effect, or otherwise arrive at a desired result.

The logic processor 1302 may include one or more physical processors (hardware) configured to execute software instructions. Additionally or alternatively, the logic processor may include one or more hardware logic circuits or firmware devices configured to execute hardware-implemented logic or firmware instructions. Processors of the logic processor 1302 may be single-core or multi-core, and the instructions executed thereon may be configured for sequential, parallel, and/or distributed processing. Individual components of the logic processor optionally may be distributed among two or more separate devices, which may be remotely located and/or configured for coordinated processing. Aspects of the logic processor may be virtualized and executed by remotely accessible, networked computing devices configured in a cloud-computing configuration. In such a case, these virtualized aspects are run on different physical logic processors of various different machines, it will be understood.

Non-volatile storage device 1306 includes one or more physical devices configured to hold instructions executable by the logic processors to implement the methods and processes described herein. When such methods and processes are implemented, the state of non-volatile storage device 1306 may be transformed—e.g., to hold different data.

Non-volatile storage device 1306 may include physical devices that are removable and/or built-in. Non-volatile storage device 1306 may include optical memory (e.g., CD, DVD, HD-DVD, Blu-Ray Disc, etc.), semiconductor memory (e.g., ROM, EPROM, EEPROM, FLASH memory, etc.), and/or magnetic memory (e.g., hard-disk drive, floppy-disk drive, tape drive, MRAM, etc.), or other mass storage device technology. Non-volatile storage device 1306 may include nonvolatile, dynamic, static, read/write, read-only, sequential-access, location-addressable, file-addressable, and/or content-addressable devices. It will be appreciated that non-volatile storage device 1306 is configured to hold instructions even when power is cut to the non-volatile storage device 1306.

Volatile memory 1304 may include physical devices that include random access memory. Volatile memory 1304 is typically utilized by logic processor 1302 to temporarily store information during processing of software instructions. It will be appreciated that volatile memory 1304 typically does not continue to store instructions when power is cut to the volatile memory 1304.

Aspects of logic processor 1302, volatile memory 1304, and non-volatile storage device 1306 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

When included, display subsystem 1308 may be used to present a visual representation of data held by non-volatile storage device 1306. The visual representation may take the form of a graphical user interface (GUI). As the herein described methods and processes change the data held by the non-volatile storage device, and thus transform the state of the non-volatile storage device, the state of display subsystem 1308 may likewise be transformed to visually represent changes in the underlying data. Display subsystem 1308 may include one or more display devices utilizing virtually any type of technology. Such display devices may be combined with logic processor 1302, volatile memory 1304, and/or non-volatile storage device 1306 in a shared enclosure, or such display devices may be peripheral display devices.

When included, input subsystem 1310 may comprise or interface with one or more user-input devices such as a keyboard, mouse, touch screen, microphone for speech and/or voice recognition, a camera (e.g., a webcam), or game controller.

When included, communication subsystem 1312 may be configured to communicatively couple various computing devices described herein with each other, and with other devices. Communication subsystem 1312 may include wired and/or wireless communication devices compatible with one or more different communication protocols. As non-limiting examples, the communication subsystem may be configured for communication via a wireless telephone network, or a wired or wireless local- or wide-area network, such as a HDMI over Wi-Fi connection. In some implementations, the communication subsystem may allow computing system 1300 to send and/or receive messages to and/or from other devices via a network such as the Internet.

In an example, an earbud comprises an earbud speaker, a microphone array including a plurality of microphones, an orientation sensing subsystem configured to output an orientation signal indicating an orientation of the earbud, and a beamforming subsystem configured to output a beamformed signal based at least on the orientation signal and a plurality of microphone signals from the plurality of microphones in the microphone array, the beamformed signal spatially selectively filtering the plurality of microphone signals. In this example and/or other examples, the beamforming subsystem optionally may be configured to set a direction of the beamformed signal relative to the earbud based at least on the orientation signal. In this example and/or other examples, the beamforming subsystem optionally may be configured to set an angular width of the beamformed signal based at least on the orientation signal. In this example and/or other examples, the orientation sensing subsystem optionally may include a touch sensor and orientation estimation logic configured to assess a gesture angle of a directional gesture on the touch sensor and output the orientation signal based at least on the gesture angle. In this example and/or other examples, the orientation estimation logic optionally may be configured to assess a plurality of gesture angles corresponding to a plurality of directional gestures and output the orientation signal based at least on the plurality of gesture angles. In this example and/or other examples, the touch sensor optionally may include a circular touch input surface. In this example and/or other examples, the orientation sensing subsystem optionally may include an accelerometer configured to measure acceleration and orientation estimation logic configured to determine a gravity vector based at least on the measured acceleration and output the orientation signal based at least on the gravity vector. In this example and/or other examples, the orientation sensing subsystem optionally may include a plurality of sensors configured to track different signals that provide an indication of the orientation of the earbud and orientation estimation logic configured to output the orientation signal based at least on the plurality of different tracked signals from the plurality of sensors. In this example and/or other examples, the orientation estimation logic optionally may be configured to distinguish between an upright position and a non-upright position of the user and filter out at least one tracked sensor signal from being used to output the orientation signal when the user is in the non-upright position. In this example and/or other examples, the plurality of sensors optionally may include a touch sensor and an accelerometer configured to measure acceleration, and the orientation estimation logic optionally may be configured to assess a gesture angle of a directional gesture on the touch sensor, determine a gravity vector based at least on the measured acceleration, and output the orientation signal based at least on the gesture angle and the gravity vector.

In another example, a method for controlling an earbud comprises receiving, from a plurality of microphones in a microphone array of the earbud, a plurality of microphone signals, receiving, from an orientation sensing subsystem of the earbud, an orientation signal indicating an orientation of the earbud, and outputting, from a beamforming subsystem of the earbud, a beamformed signal based at least on the orientation signal and the plurality of microphone signals, the beamformed signal spatially selectively filtering the plurality of microphone signals. In this example and/or other examples, the method optionally may further comprise setting a direction of the beamformed signal based at least on the orientation signal. In this example and/or other examples, the method optionally may further comprise setting an angular width of the beamformed signal based at least on the orientation signal. In this example and/or other examples, the orientation sensing subsystem optionally may include a touch sensor configured to detect touch input, and the method optionally may further comprise assessing a gesture angle of a directional gesture on the touch sensor, and the orientation signal optionally may be output based at least on the gesture angle. In this example and/or other examples, the method may further comprise assessing a plurality of gesture angles corresponding to a plurality of directional gestures on the touch sensor, and the orientation signal optionally may be output based at least on the plurality of gesture angles. In this example and/or other examples, the orientation sensing subsystem optionally may include an accelerometer configured to measure acceleration, the method optionally may further comprise determining a gravity vector based at least on the measured acceleration, and the orientation signal optionally may be output based at least on the gravity vector. In this example and/or other examples, the method may further comprise tracking, via a plurality of sensors, different signals that provide an indication of the orientation of the earbud and outputting the orientation signal based at least on the plurality of different tracked signals from the plurality of sensors. In this example and/or other examples, the method optionally may further comprise distinguishing between an upright position and a non-upright position of the user, and filtering out at least one tracked sensor signal from being used to output the orientation signal when the user is in the non-upright position. In this example and/or other examples, the plurality of sensors optionally may include a touch sensor and an accelerometer configured to measure acceleration, and the method optionally may further comprises determining a gravity vector based at least on the measured acceleration, assessing a gesture angle of a directional gesture on the touch sensor, and the orientation signal optionally may be output based at least on the gesture angle and the gravity vector.

In yet another example, an earbud comprises an earbud speaker, a microphone array including plurality of microphones, an orientation sensing subsystem including a touch sensor, an accelerometer configured to determine a gravity vector, and orientation estimation logic configured to assess a gesture angle of a directional gesture on the touch sensor and output an orientation signal indicating an orientation of the earbud based at least on the gesture angle and the gravity vector, and a beamforming subsystem configured to output a beamformed signal based at least on the orientation signal and a plurality of microphone signals from the plurality of microphones, the beamformed signal spatially selectively filtering the plurality of microphone signals.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. An earbud comprising:

an earbud speaker;

a microphone array including a plurality of microphones;

an orientation sensing subsystem configured to output an orientation signal indicating an orientation of the earbud; and a beamforming subsystem configured to set a direction of a beamformed signal relative to the earbud based at least on the orientation signal and output the beamformed signal based at least on the orientation signal and a plurality of microphone signals from the plurality of microphones in the microphone array, the beamformed signal spatially selectively filtering the plurality of microphone signals.

2. The earbud of claim 1, wherein the beamforming subsystem is configured to set an angular width of the beamformed signal based at least on the orientation signal.

3. The earbud of claim 1, wherein the orientation sensing subsystem includes a touch sensor and orientation estimation logic configured to assess a gesture angle of a directional gesture on the touch sensor and output the orientation signal based at least on the gesture angle.

4. The earbud of claim 3, wherein the orientation estimation logic is configured to assess a plurality of gesture angles corresponding to a plurality of directional gestures and output the orientation signal based at least on the plurality of gesture angles.

5. The earbud of claim 3, wherein the touch sensor includes a circular touch input surface.

6. The earbud of claim 1, wherein the orientation sensing subsystem includes an accelerometer configured to measure acceleration and orientation estimation logic configured to determine a gravity vector based at least on the measured acceleration and output the orientation signal based at least on the gravity vector.

7. The earbud of claim 1, wherein the orientation sensing subsystem includes a plurality of sensors configured to track different signals that provide an indication of the orientation of the earbud and orientation estimation logic configured to output the orientation signal based at least on the plurality of different tracked signals from the plurality of sensors.

8. The earbud of claim 6, wherein the orientation estimation logic is configured to distinguish between an upright position and a non-upright position of the user and filter out at least one tracked sensor signal from being used to output the orientation signal when the user is in the non-upright position.

9. The earbud of claim 6, wherein the plurality of sensors includes a touch sensor and an accelerometer configured to measure acceleration, and wherein the orientation estimation logic is configured to assess a gesture angle of a directional gesture on the touch sensor, determine a gravity vector based at least on the measured acceleration, and output the orientation signal based at least on the gesture angle and the gravity vector.

10. A method for controlling an earbud, the method comprising:

receiving, from a plurality of microphones in a microphone array of the earbud, a plurality of microphone signals;

receiving, from an orientation sensing subsystem of the earbud, an orientation signal indicating an orientation of the earbud;

setting, via a beamforming subsystem of the earbud, a direction of a beamformed signal based at least on the orientation signal; and outputting, from the beamforming subsystem of the earbud, the beamformed signal based at least on the orientation signal and the plurality of microphone signals, the beamformed signal spatially selectively filtering the plurality of microphone signals.

11. The method of claim 10, further comprising:

setting an angular width of the beamformed signal based at least on the orientation signal.

12. The method of claim 10, wherein the orientation sensing subsystem includes a touch sensor configured to detect touch input, and wherein the method further comprises assessing a gesture angle of a directional gesture on the touch sensor, and wherein the orientation signal is output based at least on the gesture angle.

13. The method of claim 12, further comprising:

assessing a plurality of gesture angles corresponding to a plurality of directional gestures on the touch sensor, and wherein the orientation signal is output based at least on the plurality of gesture angles.

14. The method of claim 10, wherein the orientation sensing subsystem includes an accelerometer configured to measure acceleration, wherein the method further comprises determining a gravity vector based at least on the measured acceleration, and wherein the orientation signal is output based at least on the gravity vector.

15. The method of claim 14, further comprising:

tracking, via a plurality of sensors, different signals that provide an indication of the orientation of the earbud; and outputting the orientation signal based at least on the plurality of different tracked signals from the plurality of sensors.

16. The method of claim 15, further comprising:

distinguishing between an upright position and a non-upright position of the user; and filtering out at least one tracked sensor signal from being used to output the orientation signal when the user is in the non-upright position.

17. The method of claim 15, wherein the plurality of sensors includes a touch sensor and an accelerometer configured to measure acceleration, and wherein the method further comprises determining a gravity vector based at least on the measured acceleration, assessing a gesture angle of a directional gesture on the touch sensor, and wherein the orientation signal is output based at least on the gesture angle and the gravity vector.

18. An earbud comprising:

an earbud speaker;

a microphone array including plurality of microphones;

an orientation sensing subsystem including a touch sensor, an accelerometer configured to determine a gravity vector, and orientation estimation logic configured to assess a gesture angle of a directional gesture on the touch sensor and output an orientation signal indicating an orientation of the earbud based at least on the gesture angle and the gravity vector; and a beamforming subsystem configured to output a beamformed signal based at least on the orientation signal and a plurality of microphone signals from the plurality of microphones, the beamformed signal spatially selectively filtering the plurality of microphone signals.

* * * * *